US005695234A

United States Patent [19]

Coticchio et al.

[11] Patent Number: 5,695,234

[45] Date of Patent: Dec. 9, 1997

[54] CARRYING DEVICE FOR SHOPPING BAGS

[76] Inventors: Salvatore Coticchio, 97-17 161st Ave.; Michael Coticchio, 81-07 159th Ave., both of Howard Beach, N.Y. 11414

[21] Appl. No.: 645,426

[22] Filed: May 13, 1996

[51] Int. Cl.[6] ..... B65D 33/06

[52] U.S. Cl. ..... 294/152; 294/156; 294/158

[58] Field of Search ..... 294/137, 138, 294/143, 149–159, 165, 170, 171, 74; 383/6, 13, 24–26, 29

[56] References Cited

U.S. PATENT DOCUMENTS

| | | | |
|---|---|---|---|
| 3,584,772 | 6/1971 | Robertson | 294/152 X |
| 3,912,140 | 10/1975 | Franges | 294/171 X |
| 4,112,541 | 9/1978 | Tetradis | 294/153 X |
| 4,284,219 | 8/1981 | Standel | 294/152 |
| 4,558,896 | 12/1985 | Farnworth | 294/156 |
| 5,150,938 | 9/1992 | Gans | 294/156 |

*Primary Examiner*—Johnny D. Cherry
*Attorney, Agent, or Firm*—Nathaniel Altman

[57] ABSTRACT

A shopping bag carrying device has two handles, one affixed to each end of a flexible loop-forming element in the form of a strap or a length of rope-like material. When the handles of one or more shopping bags are threaded onto the loop-forming element and the carrying device handles brought together, the device's loop is closed, thus confining the shopping bag handles and preventing them from slipping or straying. A releasable latching device is provided to hold the handles together while the carrying device is in use. Another embodiment uses only one handle at one end of the loop-forming element, the other end carrying a slotted extension through which the one handle may be passed to close the device's loop and hold the shopping bags in place.

5 Claims, 2 Drawing Sheets

22
12
20
18
28
18
34
30
30
38
32
40
10
16
40'
32'
38'
30'
36'
14
34'
30'
24
20'
22'
18
10
30
12
36
38
32
40
16
38'
40'
32'
36'
30
14
24
5
12
10
5
14
26
16
44
42
18
12
30
38
44
24
30'
14
38'
16

10a
22a
12a
30a
30a 9
10b
22b
9
12b 22b
7
7

16a
16a 50
10b
12b
48
44
46
42
10
10

16b
16b
30a'
30a'
14a
22a'
48
46

16
44
12, 14
10
42
52

CARRYING DEVICE FOR SHOPPING BAGS

FIELD OF THE INVENTION

This invention is concerned with a carrying device for shopping bags to support and retain the handles of at least one bag.

BACKGROUND OF THE INVENTION

Shoppers have become increasingly and unhappily familiar with the problems of transporting a plurality of purchases in separate shopping bags at the same time. The difficulties encountered are especially apparent with the lightweight insubstantial plastic bags provided in supermarkets and similar stores; these bags tend to be somewhat slippery and their sides and handles collapse when set down, so that fumbling and frustration result when one attempts to pick them up again.

The principal object of this invention is to provide a novel simple-to-use carrying device for eliminating the difficulties and problems discussed above. It is also the object of this invention to provide a carrying device uncomplicated in structure and inexpensive to produce. A still further object of this invention is to provide a carrying device light in weight, comfortable to hand-carry, and convenient for the shopper to bring along in pocket or purse.

Prior art devices for carrying shopping bags fall into two categories. The first group all disclose handles with grooves for surrounding and firmly holding the cord or plastic handles of a single shopping bag and include U.S. Pat. No. 2,648,797, issued Jul. 27, 1954 to Schulte; U.S. Pat. No. 2,846,714, issued Aug. 12, 1958 to Charlick; U.S. Pat. No. 3,486,684, issued Dec. 30, 1969 to Dills et al; U.S. Pat. No. 3,800,361, issued Apr. 2, 1974 to Stauffer; U.S. Pat. No. 3,913,172, issued Oct. 21, 1975 to Richards et al; and U.S. Pat. No. 4,590,540, issued May 5, 1986 to Enersen. In the second group of prior art devices are rigid structures each having slots or notches into which handles of one or more shopping bags may be inserted for carrying the bags; these include U.S. Pat. No. 3,207,397, issued Sep. 21, 1965 to Wilson; U.S. Pat. No. 3,306,507, issued Feb. 28, 1967 to Wilson; U.S. Pat. No. 4,112,542, issued Sep. 12, 1978 to Snyder; and U.S. Pat. No. 4,841,596, issued Jun. 27, 1989 to Fink.

SUMMARY OF THE INVENTION

In contrast to the disclosures and concepts of the prior art outlined above, the carrying device of the present invention has a flexible loop-forming element depending from a rigid handle. In use, the loop-forming element is simply passed through the handle openings of as many shopping bags as desired or as can be carried together and the loop is then closed by releaseable attachment means. The shopping bag handles are retained within the closed loop, and the combined package may be put down, picked up and carried to its destination where the loop may be easily reopened and the shopping bags dispersed.

The preferred embodiments of this invention will be disclosed and described in full detail in connection with the accompanying illustrative but not limiting drawings, wherein:

SHORT FIGURE DESCRIPTION OF DRAWING

DESCRIPTION OF THE PREFERRED EMBODIMENTS

Figures 1, 2, 3, 4, 5:
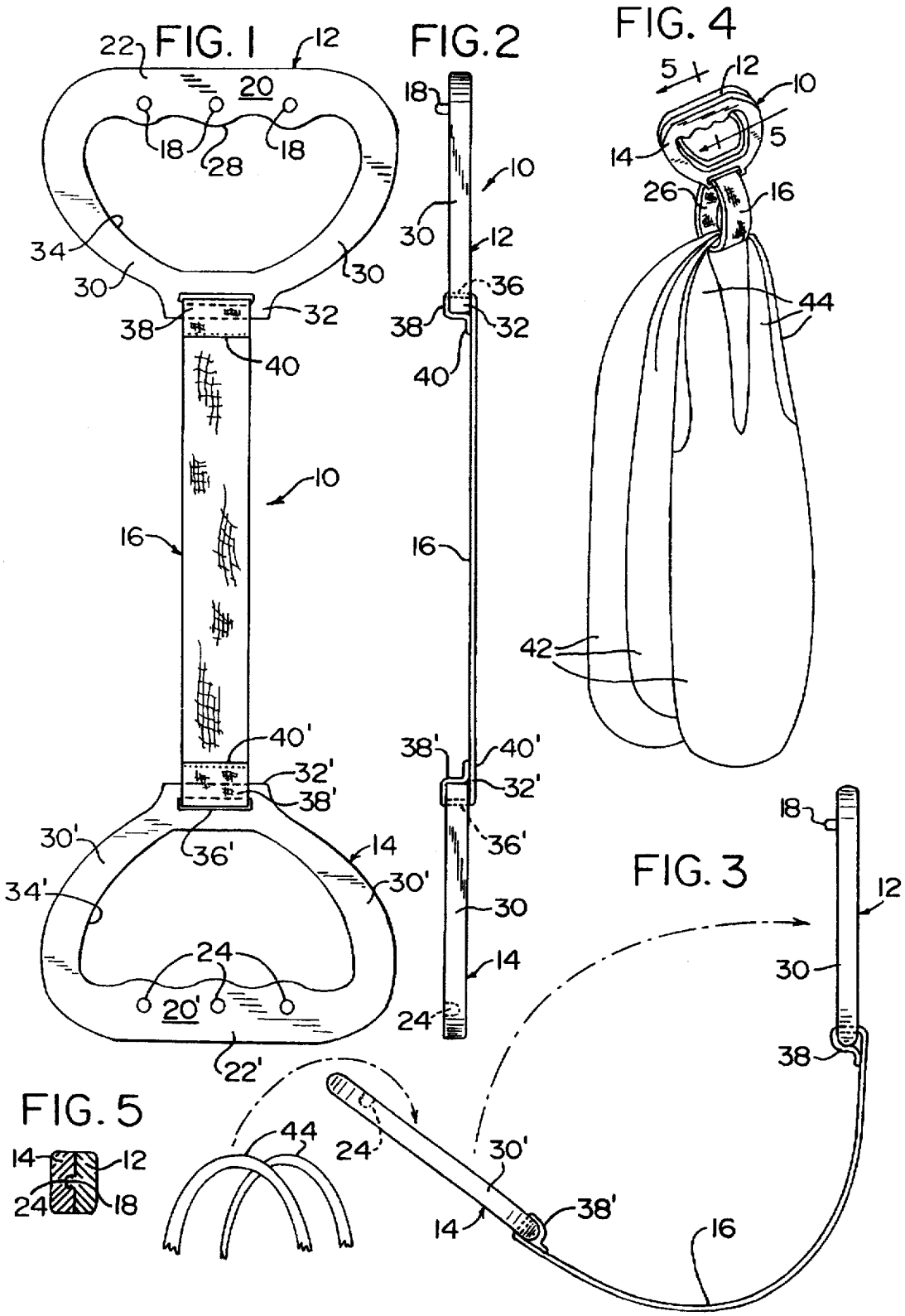
FIG. 1 is a plan view of a preferred embodiment of a shopping bag carrying device made in accordance with this invention.
FIG. 2 is a side elevational view of the device of FIG. 1.
FIG. 3 is a view similar to FIG. 2 with its loop-forming element flexed and ready to accept shopping bag handles thereon.
FIG. 4 is a perspective view of the embodiment of FIGS. 1–3 in closed operative position and supporting a plurality of shopping bags.
FIG. 5 is a sectional view taken along line 5—5 of FIG. 4.

As shown in FIGS. 1–5, shopping bag carrying device 10 has a pair of handles 12 and 14 connected by flexible loop-forming element 16. Handles 12 and 14 are identical in every respect except one: handle 12 has three spaced projections 18 extending from inner surface 20 of hand-gripping portion 22 thereof, while handle 14 has three sockets 24 complementary to, and positioned on inner surface 20' of hand-gripping portion 22' for mating relationship with, projections 18 when handles 12 and 14 are brought together to close loop 26 of element 16 as seen in FIGS. 4.

Hand-gripping portions 22 and 22' of handles 14 and 16, respectively, are shaped at 28, 28' to accommodate comfortably the user's fingers on bag-carrying device 10 when in use. Extending inwardly from each side of portions 22, 22' toward device 10's center and laterally are curved arms 30, 30', each pair of which terminates and is connected to rectangularly-shaped inner end 32, 32' of handles 12, 14 respectively. Centrally disposed spaces 34, 34', defined by ends 32,32', curved arms 30,30' and portions 22, 22' provide room for the carrier's hand when holding device 10. Inner ends 32, 32' have centrally disposed slots 36, 36' to accommodate rotatably looped ends 38, 38' of loop-forming element 16, looped ends 38, 38' being secured in place by stitching 40, 40'.

Handles 14 and 16 of device 10 may be fashioned from any rigid material that is sufficiently strong—plastics, wood, composition board, even pressed paper, may be used. As illustrated, loop-forming element 16 may be a flexible, strong, durable material such as woven nylon fabric; however, the use of other strong fabrics, natural or synthetic rubber, plastics, leather, in the form of flat strips or elements of rounded cross-section, ropes and the like is envisioned.

FIGS. 3–5 illustrate the utter simplicity of using device 10 to carry plastic shopping bags 42 (FIG. 4). In FIG. 3, shopping bag handles 44 are about to be strung over handle 14 and onto loop-forming element 16 of device 10; thereafter, bringing handles 14 and 12 together closes loop 26 and releasably snaps mating fastening elements 18 and 24 together (FIG. 5). Strap-handles 44 are thus confined within loop 26, restrained and prevented from slipping, drooping or tangling (FIG. 12) until device 10 is intentionally opened by pulling apart fastening elements 18 and 24; the transporting of multiple shopping bags is thus made more likely to be less stressful and more serene. It may be noted that while only thin plastic shopping bags 42 with integral strap-handles 44 are shown in the drawings, device 10 may be used to good advantage with pluralities of sturdier bags with cord or similar handles.

Figures 6, 7, 8, 9, 10, 11, 12:
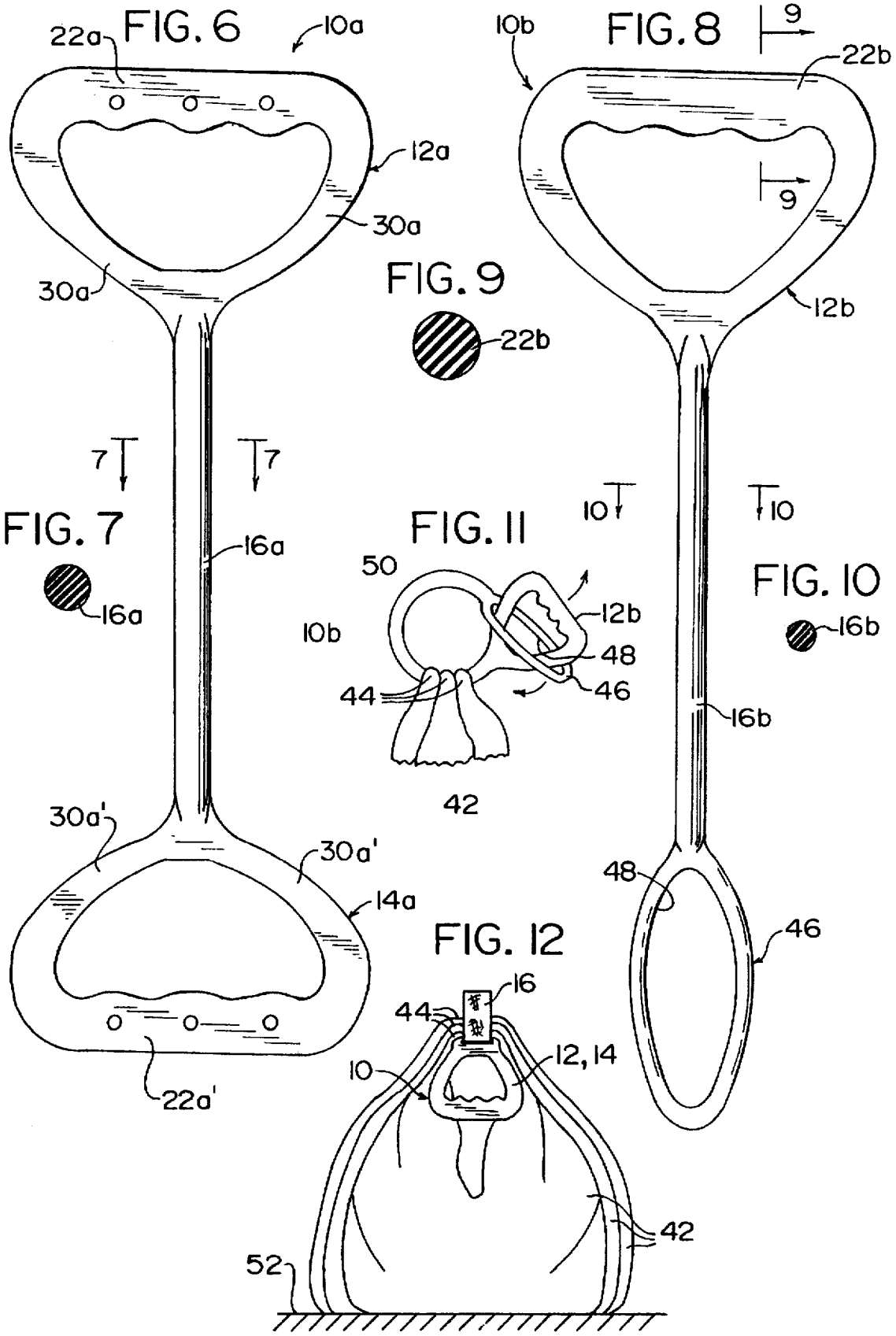
FIG. 6 is a plan view of a second preferred embodiment of this invention.
FIG. 7 is a sectional view taken along line 7—7 of FIG. 6.
FIG. 8 is a plan view of still another preferred embodiment of a carrying device of this invention.
FIG. 9 is a sectional view taken along line 9—9 of FIG. 8.
FIG. 10 is a sectional view taken along line 10—10 of FIG. 8.
FIG. 11 is a perspective view of the device of FIG. 8 with its loop-forming element supporting a plurality of shopping bags and being put into its closed carrying position.
FIG. 12 is an elevational view of the carrying device of FIGS. 1–5 similar to FIG. 4, but with its plurality of shopping bags set down.

Another embodiment 10*a* of the shopping bag carrying device of this invention is shown in FIG. 6 which differs from device 10 of FIGS. 1–5 in that device 10*a* is made of a single molded piece of natural rubber, synthetic rubber or plastic (e.g. nylon). In embodiment 10*a*, handles 12*a* and 14*a* are identical in size, shape and function to those corresponding handles 12 and 14 of device 10, except that curved arms 30*a*, 30*a*' extend from hand-gripping portions 22*a*,22*a*' directly into loop-forming element 16*a* which, as seen in FIG. 7, is of circular cross-section. In every other respect, device 10*a* is, and is used, precisely the same as device 10.

FIGS. 8–11 illustrate still another embodiment of this invention wherein shopping bag carrying device 10*b* is shown as an integral unit with single handle 12*b* merging directly into loop-forming element 16*b*, the opposite end of which carries elliptically shaped extension 46. Elongate slot 48 in extension 46 makes it possible, when element 16*b* is being formed into closed loop 50 (FIG. 11), for handle 12*b* to be pushed therethrough and thereby keep device 10*b* in closed operative position as long as the user desires, then for the procedure to be reversed. As shown in FIG. 9, hand-gripping portion 22*b* of handle 12*b* is of circular cross-section, as is loop-forming element 16*b* shown in FIG. 10. Device 10*b* may be formed from any of the materials mentioned above for device 10*a*, or may be also produced optionally from assembled parts, rather than the unitary structure of FIG. 8, using any of the materials mentioned above in connection with device 10.

In FIG. 12, the shopping bag carrying device 10 is shown in use on a plurality of shopping bags 42 resting on surface 52, with handles 12, 14 hanging downwardly from loop-forming element 16, and shopping bag handles 44 restrained and held in disciplined fashion by element 16, to make picking up the combined package by handles 12,14 an unstressful experience. Carrying device embodiments 10*a* and 10*b* will perform equally well.

The preferred embodiments of this invention have been disclosed and illustrated in full detail. It will be evident to those skilled in the art that other embodiments, modifications and substitutions may be made without departing from the concepts and the spirit of the invention, which are limited only by the scope of the ensuing claims.

What we claim is:

1. In combination with shopping bags having handles, a shopping bag carrying device, which comprises:

a pair of handle members, one of said handle members being positioned at each end of the shopping bag carrying device, each said handle member having one substantially planar face and further comprising:

a hand-gripping portion at the outer end of each said handle member;

a pair of arms spacedly attached to, and extending inwardly, one from each side of said hand-gripping portion; and an inner portion of each said handle member connected to the inner ends of said pair of arms, said inner portion having a rectangular slot centrally disposed therein, said hand-gripping portion, said pair of arms and said inner portion defining an interior space within each said handle member, said interior space providing room for the user's hand to grasp said hand-gripping portion;

a flexible loop-forming element having one end thereof looped and rotatably secured through said rectangular slot to, and extending inwardly from, said inner portion of each said handle member, the longitudinal axis of said loop-forming element thereby being transverse to the longitudinal axis of said pair of handle members; and means for releasably holding said pair of handle members together when said substantially planar faces thereof are placed in mating contact with each other, whereby, when the handles of at least one shopping bag are placed on said loop-forming element and the loop created from said loop-forming element has been closed around the shopping bag handles by bringing said pair of handle members together and engaging said holding means, the shopping bag carrying device is in operative position, preventing the shopping bag handles from slipping and scattering while said loop remains closed.

2. The shopping bag carrying device of claim 1, wherein said means for releasably holding said pair of handle members comprises said two handle members carrying mating complementary fastening means on each said one substantially planar face, said planar faces being brought into contact and said fastening means into engagement to form said closed loop around the shopping bag handles and thereby to place the shopping bag carrying device in operative position.

3. The shopping bag carrying device of claim 2, wherein said mating complementary fastening means comprises:

at least one projection extending from said one substantially planar face of one of said pair of handle members; and at least one socket opening in said one substantially planar face of the second of said pair of handle members, said at least one socket opening being positioned and sized to accommodate and releasably hold said at least one projection when said loop is closed around the shopping bag handles and the shopping bag carrying device is in its operative position.

4. The shopping bag carrying device of claim 1, wherein said loop-forming element is a substantially flat strip formed from a material selected from the group consisting of: woven synthetic fiber fabric, woven natural fiber fabric, natural rubber, synthetic rubber, molded plastic, extruded plastic and leather.

5. The shopping bag carrying device of claim 1, wherein said inner portion of each said pair of handle members is substantially rectangular in shape and said centrally disposed rectangular slot therein is dimensioned to permit one end of said loop-forming element to be fittingly looped through each of said slots, each said loop-forming element end being fastened into a closed loop, whereby said loop-forming forming element is rotatably secured to said pair of handle members.

* * * * *